US005294208A

United States Patent [19]

Tremmel, Jr. et al.

[11] Patent Number: 5,294,208

[45] Date of Patent: Mar. 15, 1994

[54] NOTEBOOK-TYPE PERSONAL ORGANIZER

[75] Inventors: Richard J. Tremmel, Jr., Secaucus, N.J.; Thomas W. Cushing, New York, N.Y.

[73] Assignee: Insilco Corporation, Secaucus, N.J.

[21] Appl. No.: 814,790

[22] Filed: Dec. 31, 1991

[51] Int. Cl.[5] ..... B42F 5/00

[52] U.S. Cl. ..... 402/70; 402/73; 281/31; 281/15.1

[58] Field of Search ..... 402/73, 70, 79, 80 R; 283/62; 281/15.1, 21.1, 31

[56] References Cited

U.S. PATENT DOCUMENTS 4,971,362 11/1990 Lapsker ..... 283/62 X
4,973,184 11/1990 La Salle ..... 402/70
5,033,899 7/1991 Pitts et al. ..... 402/79

FOREIGN PATENT DOCUMENTS 2248693 6/1975 France ..... 402/79

*Primary Examiner*—Mark Rosenbaum
*Assistant Examiner*—Willmon Fridie, Jr.
*Attorney, Agent, or Firm*—Burns, Doane, Swecker & Mathis

[57] ABSTRACT

A notebook-type personal organizer comprises a multi-ring binder to which a plurality of leaves is connected. Plastic bags are connected to the binder, and each bag contains a pad of adhesive-backed paper sheets. The bags are adhered to a stiff posting sheet by means of a releasable adhesive to keep the bags from sagging and tearing. The user removes the pads from the bags and inserts them into pockets formed in a front panel of the organizer. Once a note is written on a paper sheet, the paper sheet can be removed from the pad and then adhered to the posting sheet for future reference. The posting sheet can be removed from, and inserted onto, the binder rings without opening those rings, and can be used as a straight edge or a distance-measuring ruler, and also to mark the proper day among the calendar pages of the organizer.

26 Claims, 5 Drawing Sheets

NOTEBOOK-TYPE PERSONAL ORGANIZER

BACKGROUND OF THE INVENTION

The present invention relates to a notebook-type personal organizer.

One convenient way of keeping track of important names, addresses, telephone numbers, special events, etc., is by recording them in a notebook. Notebooks specifically designed for that task, often called personal organizers, contain alphabetically arranged pages having printed indicia thereon for directing a user where to inscribe names, addresses, telephone numbers, as well as chronologically arranged pages having printed calendar indicia where the user can inscribe the dates of special events such as meetings, appointments, birthdays, etc.

It would be desirable to enhance the versatility of such personal organizers, especially to enable a user to inscribe messages or reminders which can be placed in a particular location in the organizer and discarded, and also to more easily locate a particular calendar page.

SUMMARY OF THE INVENTION

The present invention relates to a notebook-type organizer comprising a plurality of pages on which information can be inscribed by a user. At least one pad of paper sheets is provided, the sheets being removably secured together by a releasable adhesive so that the sheets can be removed from the pad one at a time. Provision is made for supporting the pad internally of the binder, and for supporting the paper sheets after they have been removed from the pad.

Preferably, the pad is supported on an inner surface of a panel of the notebook by being mounted within a pocket formed in that surface.

The leaves of the notebook preferably include a stiff posting sheet to which the paper sheets can be adhesively applied when moved from the pad.

The posting sheet preferably includes slots which are open along one edge of the plastic sheet to enable the plastic sheet to be inserted and removed from binder rings of the notebook without opening the rings.

The leaves of the organizer include calendar pages. The posting sheet is larger than the calendar pages. The posting sheet can thus act as a day-marker by being positioned next to a particular one of the calendar pages.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 5:
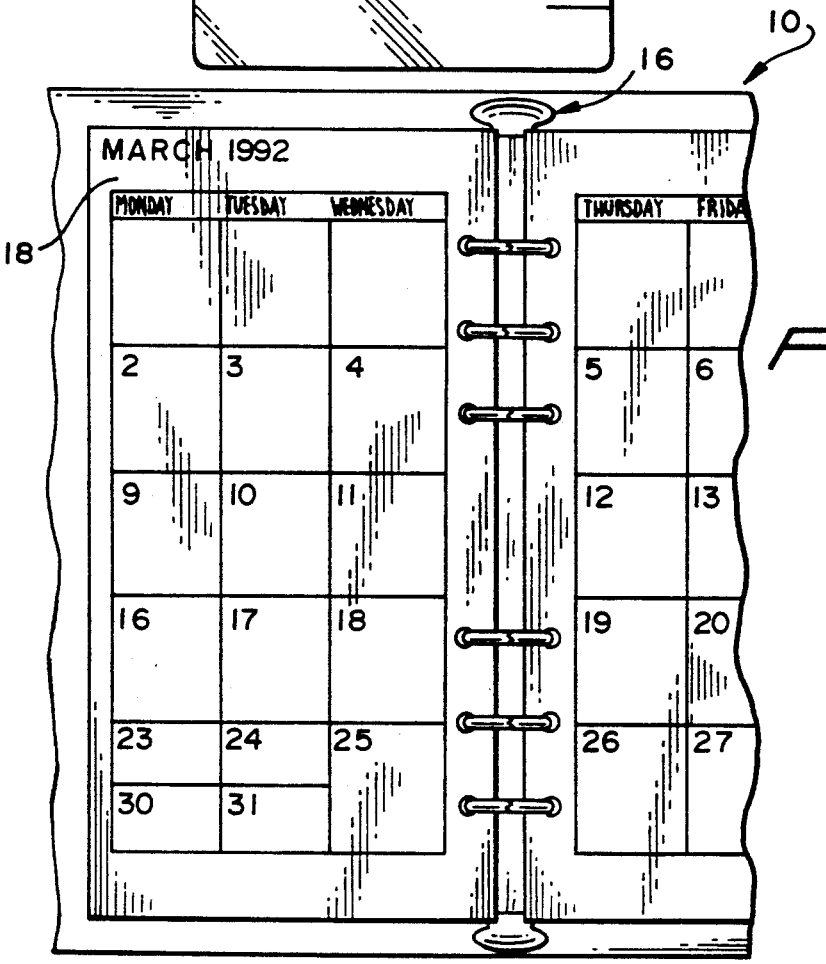
FIG. 5 is a fragmentary front view of the personal organizer, depicting calendar sheets thereof.
Figure 6:
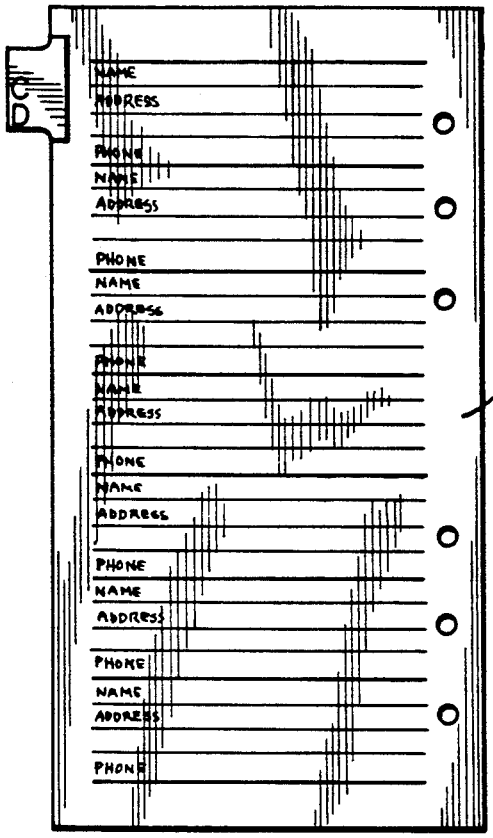
FIG. 6 is a front view of an address page of the personal organizer.

A personal organizer 10 of a notebook-type comprises front and rear cover panels 12, 14 and a binder ring arrangement 16. A plurality of leaves are held by the binder. The leaves include chronologically arranged paper pages 18 (see FIG. 5) which contain printed calendar indicia forming spaces in which a user can inscribe special events. Alphabetically arranged paper pages 20 (FIG. 6) contain printed address indicia directing a user where to inscribe names, addresses, telephone numbers, etc.

Figure 2:
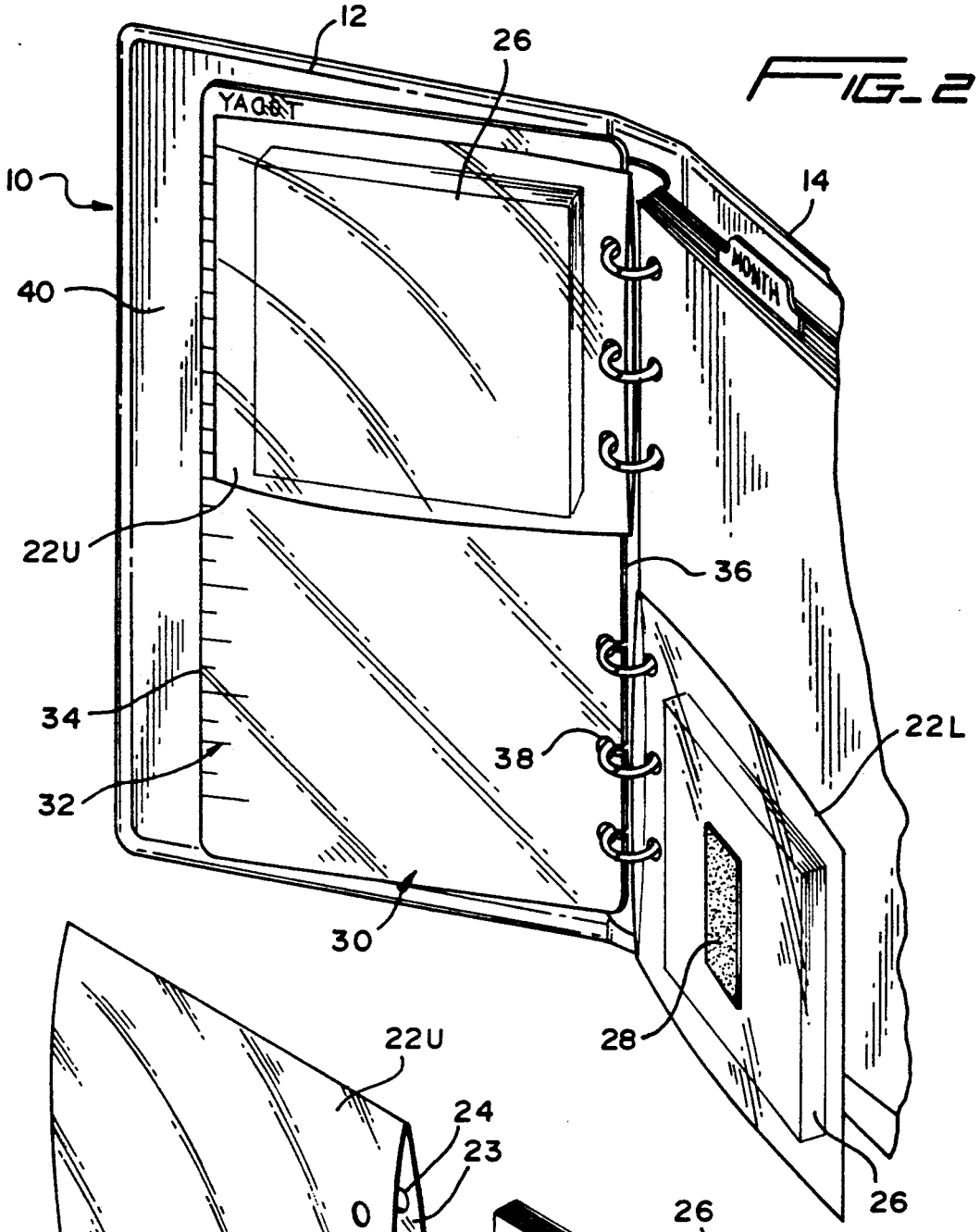
FIG. 2 is a view similar to FIG. 1, depicting the pads being carried in plastic bags prior to being mounted in the front panel.
Figure 3:
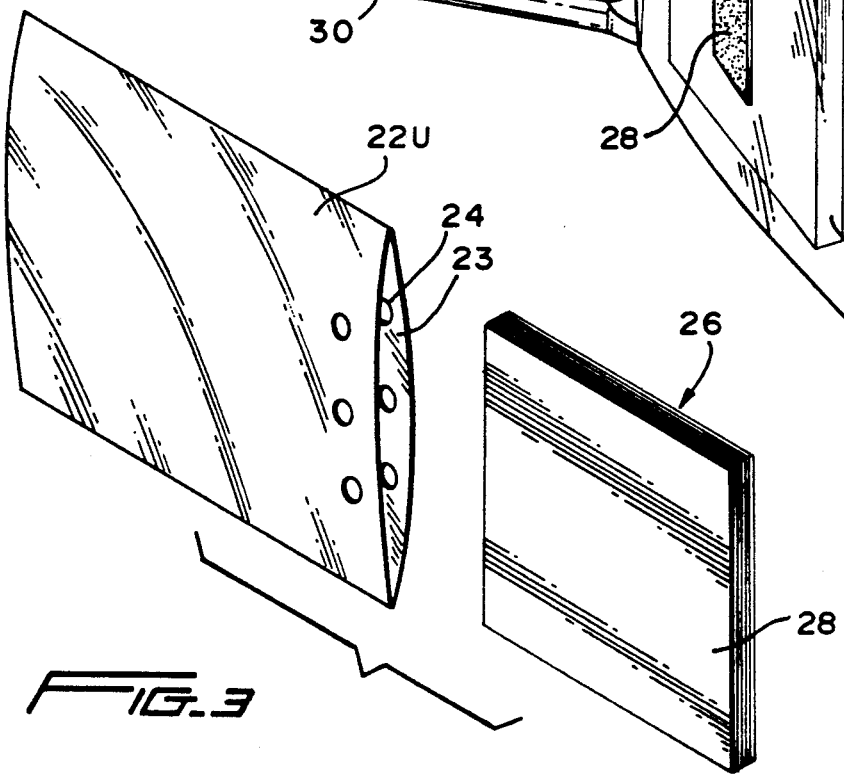
FIG. 3 is a perspective exploded view of a pad and a carrying bag therefor.

Attached within the notebook are two upper and lower bags 22U, 22L (FIGS. 2, 3) formed of a flexible plastic. Each bag includes a plurality of holes 24 for releasable attachment to the binder rings. The upper bag 22U is secured to upper ones of the binder rings, and the lower bag 22L is secured to lower ones of the binder rings.

Carried within each of the bags is a conventional pad 26 comprised of a stack of paper sheets 28 which are secured together by strips of releasable adhesive. The sheets can be separated one-at-a-time and then adhered to a desired surface. Such pads are commercially available under the name Post-It ®. The bags 22U, 22L have openings 23 at their edges containing the holes 24, whereby the pads 26 cannot be removed from the bags as long as the bags are attached to the binder rings.

The personal organizer 10 is intended to be marketed with the pads 26 disposed within the bags 22. The user will then remove the pads 26 and mount them elsewhere within the notebook as will be hereinafter explained.

It will be appreciated that the bags will tend to sag, due to the weight of the pads 26. Such sagging is unsightly and could result in the bag tearing from the binder rings. In order to prevent the bags from tearing until the user removes and repositions the pads, external surfaces of the bags are provided with releasable adhesive strips 28 which are releasably adhered to one of the leaves, preferably to a stiff posting sheet 30 formed of plastic (see FIGS. 2, 4) which is located adjacent the bags 22U, 22L.

The posting sheet 30 is preferably formed of a transparent plastic. Distance-measuring indicia 32 is printed along one edge 34 thereof, whereby that edge can be used as a straight edge or as a measuring ruler. The opposite edge 36 thereof contains a plurality of slots 38 (see FIG. 4) which are open at that edge 36. The slots are arranged to enable the sheet 30 to be inserted onto, or removed from, the binder rings without having to open the binder rings. This enables the posting sheet 30 to be used as a day marker in the sense that it can be inserted among the calendar pages at the correct day. The user will be able to quickly locate this sheet, because it is larger than the calendar pages, i.e., preferably taller, and is imprinted with the word "today" along its upper edge. Since the posting sheet is taller than the calendar pages, the word "today" will be clearly visible to the user.

Furthermore, as will be later explained, the adhesive pages of the pad can be posted on either side of the posting sheet.

The inner surface 40 of the front panel 12 is formed by a flexible plastic liner, preferably vinyl, which includes a pair of pockets 31. The pockets 31 include respective slits 42U, 42L, each being sized to receive one or more of the bottommost paper sheets 44 of a respective pad 26. Thus the pads 26 can be inserted through the slits 42U, 42L and become supported by the respective pockets, so as to expose the topmost sheet 46 of each pad to be inscribed by the user.

Figure 1:
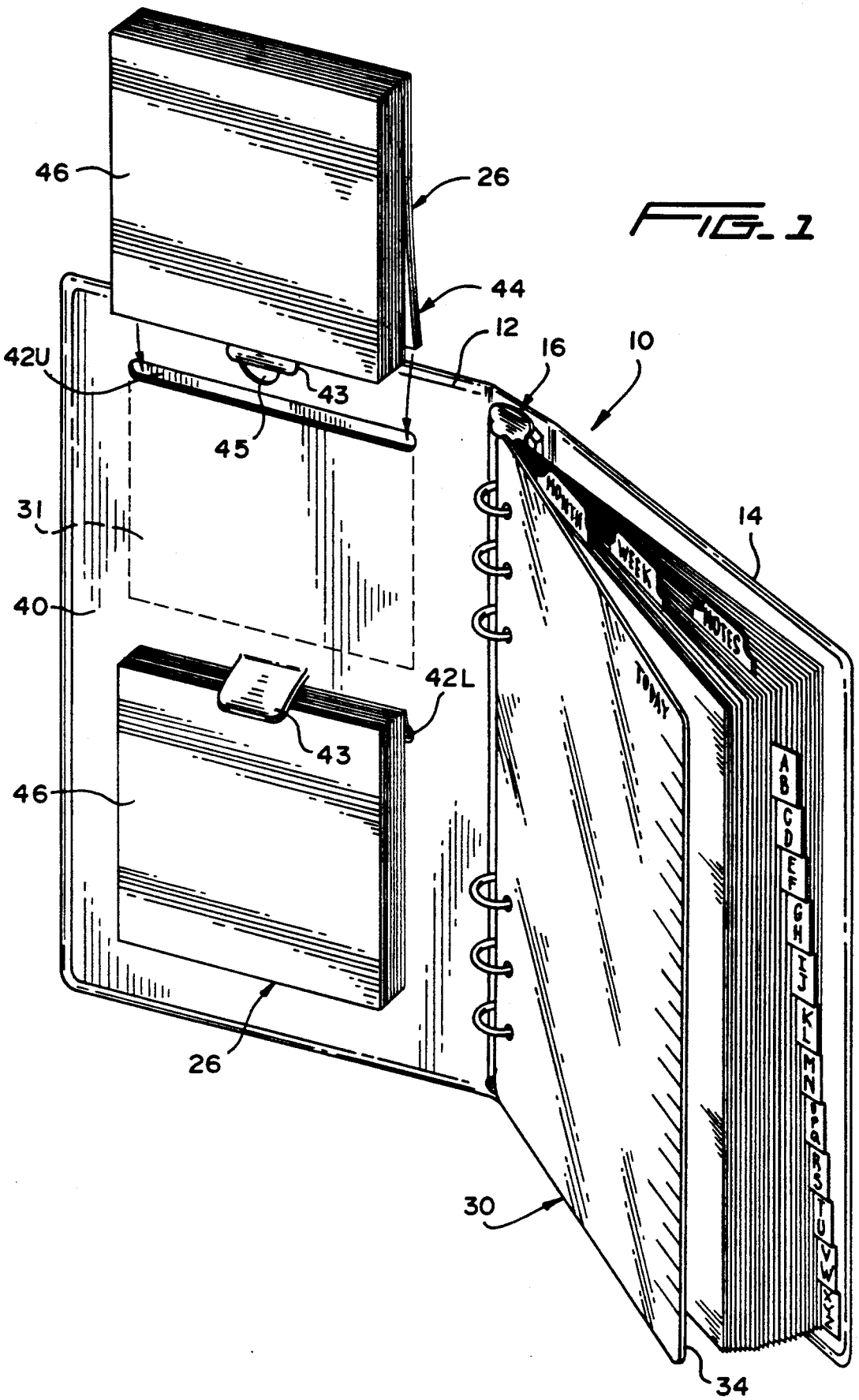
FIG. 1 is a front perspective view of a notebook-type personal organizer according to the present invention, with two pads of adhesively secured sheets being mounted in a front panel thereof.

The lining includes a flexible flap 43 disposed adjacent the opening of the pocket. The flap can be lifted by the user while a pad is being inserted in the pocket. Thereafter, the flap will overlap an upper edge of the topmost sheet of the pad to aid in securing the pad within the pocket, as depicted in FIG. 1. A recess 45 can be formed in the liner along a lower surface of the flap 43 to enable a user to more easily insert a finger beneath the flap in order to raise the flap.

Figure 4:
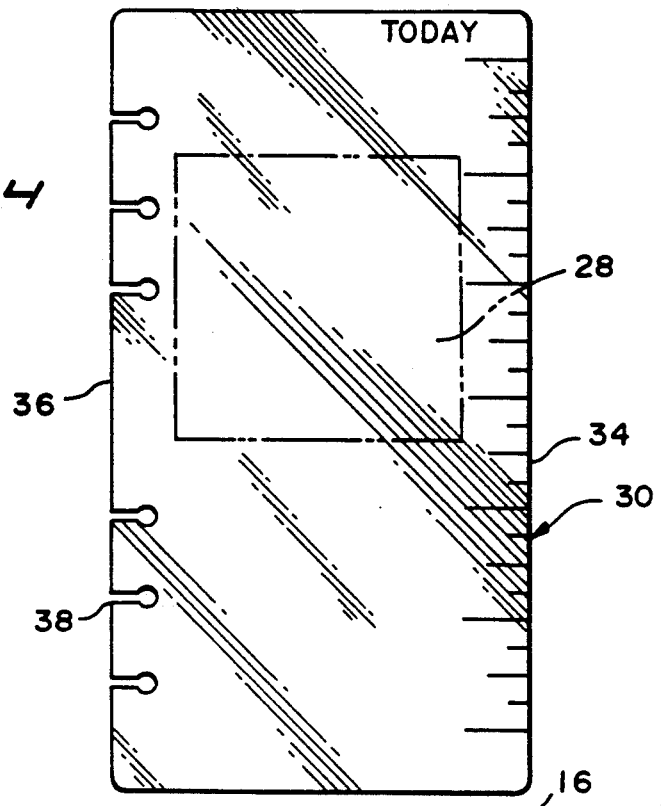
FIG. 4 is a front view of a plastic sheet which functions as a straight edge, a measuring ruler, or a posting board for the paper sheets of the pad.

Once inscribed, the paper sheet(s) 46 can be left on the pad, or removed therefrom and adhered to either side of the posting sheet 30, as depicted in FIG. 4. Both sides of the plastic sheet 30 thus serve, in effect, as posting surfaces for messages deemed of importance by the user.

Figure 7:
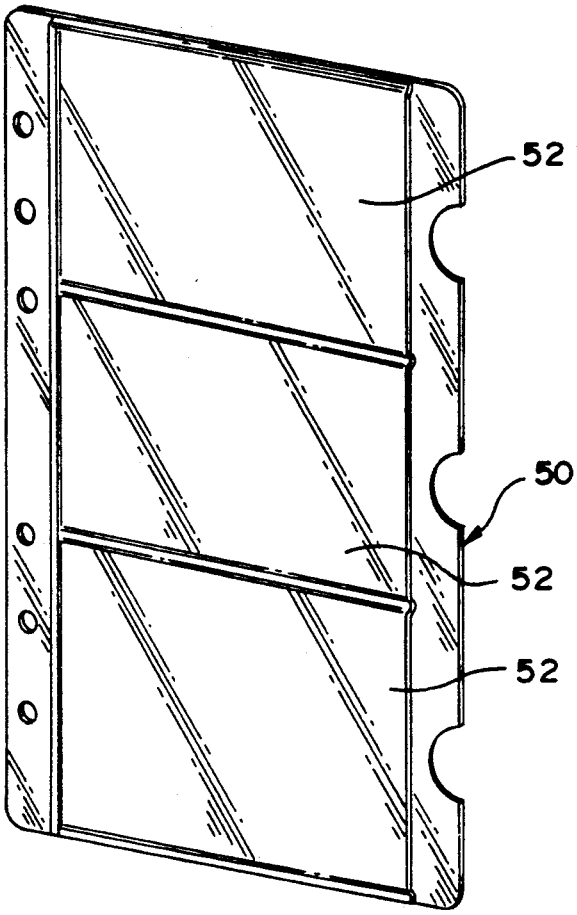
FIG. 7 is a perspective view of a flexible plastic sheet for containing business cards or credit cards, etc.

Another of the leaves includes a flexible plastic sheet 50 depicted in FIG. 7 which includes a plurality of pockets 52 open at one of the vertical edges of the sheet to receive cards, such as business cards, credit cards, etc.

Figure 8:
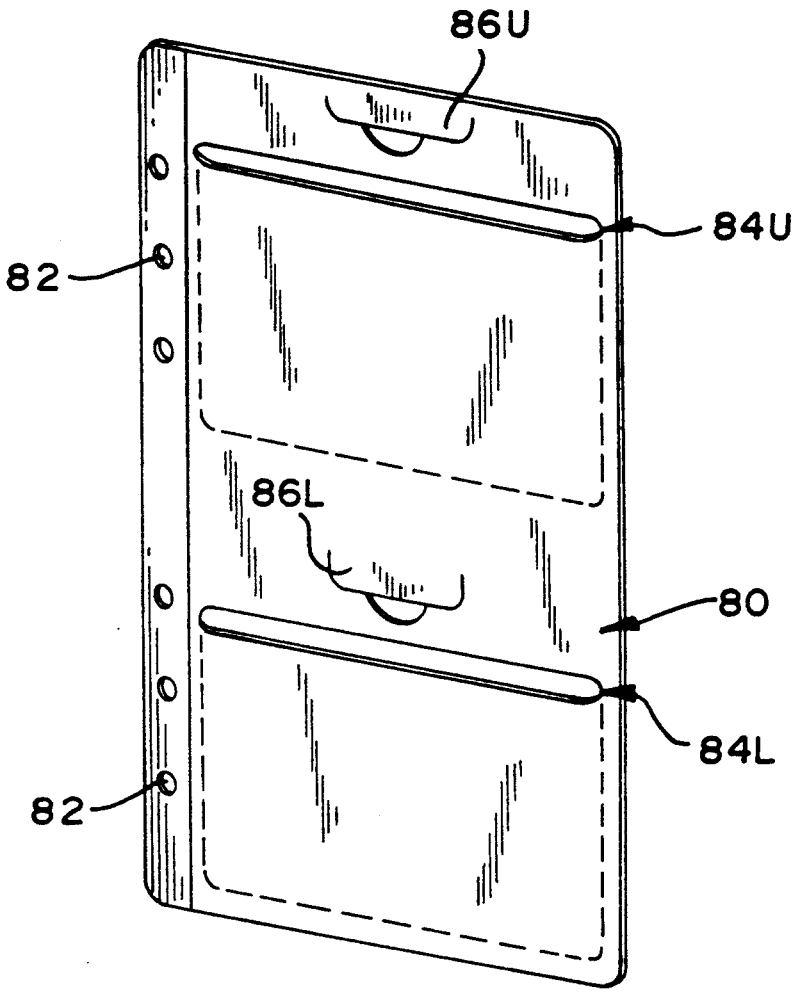
FIG. 8 is a perspective view of a removable plastic sheet for supporting pads of paper according to the invention.

FIG. 8 depicts an alternative way of supporting pads 26 within the organizer. That is, a leaf or page 80 formed of a flexible plastic, such as vinyl for example, has a plurality of holes 82 along one edge to enable the page 80 to be inserted or removed from a ring-type binder. At least one face of the page 80 includes a pair of pockets 84U, 84L sized to receive the pads 26 in the same manner as the earlier described pockets 42U, 42L. Also, a pair of flaps 86U, 86L are disposed above the respective pockets to function in the same manner as the forementioned flaps 43.

It will be appreciated that the page 80 enables the pads to be placed at any desired location within the organizer and/or to be transferred between different organizers, if desired.

In practice, a user purchases the personal organizer with the pads 26 disposed within the bags 22U, 22L. The bags do not sag, because they are adhered to the posting sheet 30 by means of the adhesive strips 28. The user peels the bags off the plastic sheet 30 and removes them from the binder rings 16. That serves to expose the bag openings 23 to enable the pads 26 to be removed. The bags are discarded, and a group of the bottommost sheets 44 of each pad are inserted through the respective slit 42U, 42L and into the associated pocket 31 of the front panel 12, as depicted in FIG. 1. Alternatively, the pads can be inserted into the pockets 84U, 84L of the page 80 (FIG. 8). A user can then inscribe notes on the topmost sheet 46 and either leave that sheet in place or remove that sheet from the pad and adhere it to either side of the posting sheet 30, as depicted in FIG. 4. After the message on the paper sheet 46 is no longer relevant, it can be thrown away.

The posting sheet 30 can be pulled from the binder rings without having to open the rings, in order to use the edge 34 of the posting sheet 30 as a straight edge for drawing lines, or as a ruler for making distance measurements. The posting sheet 30 can be reinserted among the calendar pages of the binder in order to enable the user to quickly locate the proper calendar pages by observing the "today" indicia on the top edge of the posting sheet. Cards, such as business cards, can be inserted into the pockets 52 of the sheet 50 shown in FIG. 7.

It will be appreciated that the personal organizer enables messages to be recorded and then discarded when no longer needed. The messages can be posted on the posting sheet for convenient reference. The posting sheet also enables lines to be drawn, or measurements to be made, and also serves as a day-marker for the calendar pages.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A notebook-type organizer comprising a binder having front and rear panels, a plurality of paper pages mounted in said binder upon which information can be inscribed by a user, at least one pad of removable paper sheets removably secured together by a releasable adhesive, said sheets being removable one-at-a-time from said pad, and supporting means for supporting said pad internally of said binder, and means to which the sheets can be attached by said adhesive once removed from said pad, said supporting means comprising a surface having a pocket formed therein, said pocket including a narrow slit which receives a bottom portion of said pad such that said pad bottom portion is covered and retained by a portion of said surface, and an upper portion of said pad lies above said portion of said surface so as to be exposed for being grasped by a user.

2. A notebook-type organizer according to claim 1, wherein each panel has an inside surface, said pocket being formed on one of said inside surfaces.

3. A notebook-type organizer according to claim 2, wherein said one inside surface includes a flexible retaining flap disposed adjacent said pocket for overlapping a top sheet of said pad.

4. A notebook-type organizer according to claim 1, wherein there are two said pads and two said pockets.

5. A notebook-type organizer according to claim 4, wherein said pockets are spaced above and below one another.

6. A notebook-type organizer according to claim 1, wherein paper sheets of said pad are adhered to one another by an adhesive strip disposed along a back edge of each paper sheet, a stiff posting sheet mounted in said binder and defining said means to which said paper sheets can be attached by said adhesive when removed from said pad.

7. A notebook-type organizer according to claim 6, wherein said posting sheet includes distance-measuring indicia along one edge thereof.

8. A notebook-type organizer according to claim 6, wherein said binder includes binder rings which can be opened and closed, said posting sheet having slots which are open at another edge of said posting sheet for enabling said posting sheet to be inserted and removed from said binder rings without opening said binder rings.

9. A notebook-type organizer according to claim 8, wherein said paper sheets include chronologically arranged calendar pages having calendar indicia thereon, said posting sheet being insertable among said calendar pages and being larger than said calendar pages, whereby said posting sheet constitutes a day-marker enabling a user to quickly locate a particular calendar page.

10. A notebook-type organizer according to claim 1, wherein said binder includes binder rings which can be opened and closed, said supporting means comprising a plastic page mounted on said binder rings and including said pocket.

11. A notebook-type organizer according to claim 10, wherein said plastic page includes a flexible retaining flap disposed adjacent said pocket for overlapping a top sheet of said pad.

12. A notebook-type organizer comprising a multi-ring binder, a plurality of leaves mounted in said binder, some of said leaves comprising paper pages on which information can be inscribed by a user, at least one pad of paper sheets removably secured together by an adhesive strip disposed along a back edge of each paper sheet, so that said sheets can be removed from said paid one-at-a-time, and a flexible bag in which said pad is removably contained, said bag having one edge thereof secured directly to rings of said multi-ring binder, said bag also being adhered to one of said leaves by a releasable adhesive.

13. A notebook-type organizer according to claim 12, wherein said leaf to which said bag is adhered comprises a plastic sheet.

14. A notebook-type organizer according to claim 13, wherein said plastic sheet includes distance-measuring indicia along one edge thereof.

15. A notebook-type organizer according to claim 14, wherein said binder means comprises a multi-ring binder, said plastic sheet including slots open at one edge thereof to enable said plastic sheet to be removed from, and inserted into, the rings of said binder without opening said rings.

16. A notebook-type organizer according to claim 12, including supporting means in which said pad can be mounted when removed from said bag.

17. A notebook-type personal organizer according to claim 15, including front and rear panels, each panel having an inside surface, said supporting means comprising a pocket formed on one of said inside surfaces for receiving a bottom portion of said pad.

18. A notebook-type personal organizer according to claim 17, wherein said inside surface includes a flexible retaining flap disposed adjacent said pocket for overlapping a top sheet of said pad.

19. A notebook-type personal organizer according to claim 16, wherein said binder includes front and rear panels, said supporting means comprising a flexible plastic sheet disposed between said panels and including at least one pocket for receiving a bottom portion of said pad.

20. A notebook-type personal organizer according to claim 19, wherein said flexible plastic sheet includes a flexible retaining flap disposed adjacent said pocket for overlapping a top sheet of said pad.

21. A notebook-type organizer comprising a binder having front and rear panels and binder rings, a plurality of paper pages mounted on said binder rings upon which information can be inscribed by a user, some of said paper pages including chronologically arranged calendar pages having calendar indicia printed thereon, a day-marker sheet having slots along one edge thereof, each of said slots including a narrow portion extending to said one edge and a wider portion disposed remotely from said one edge for enabling said day-marker sheet to be inserted and removed from said binder rings without opening said binder rings, said day-marker sheet being insertable among said calendar pages and including a portion projecting beyond said calendar pages to be quickly locatable by a user, said day-marker sheet having distance-measuring indicia along an edge thereof disposed opposite said one edge.

22. A pad retainer for use in a loose-leaf notebook type personal organizer having openable binder rings, said pad retainer comprising a plastic page having a plurality of apertures mountable to the binder rings, and at least one pocket formed in a surface of said page, said pocket including a narrow slit which receives a bottom portion of said pad such that said pad bottom portion is covered and retained by a portion of said surface, and an upper portion of said pad lies above said portion of said surface so as to be exposed for being grasped by a user.

23. A pad retainer according to claim 22, wherein said plastic page includes a flexible flap disposed adjacent said pocket for overlapping an edge of the pad.

24. A pad retainer according to claim 23, wherein there are two said pockets and two said flaps formed in said plastic pad.

25. A notebook-type organizer according to claim 12, wherein said bag is open along said one edge and is closed along its remaining edges, so that the pad can be removed from said bag only by removing said bag from the binder rings.

26. A notebook-type organizer comprising a binder having front and rear panels, a plurality of paper pages mounted in said binder upon which information can be inscribed by a user, at least one pad of removable paper sheets removably secured together by a releasable adhesive said sheets being removably one-at-a-time from said pad, and supporting means for supporting said pad internally of said binder, and means to which the sheets can be attached by said adhesive once removed from said pad wherein each panel has an inside surface, said supporting means comprising a pocket formed in one of said inside surfaces for receiving a bottom portion of said pad, said one inside surface including a flexible retaining flap disposed adjacent said pocket for overlapping a top sheet of said pad.

* * * * *